United States Patent [19]

Porter

[11] 3,995,571

[45] Dec. 7, 1976

[54] WORK FEEDER FOR SEWING MACHINE

[76] Inventor: Robert E. Porter, 5 Oak St., Hamilton, Mass. 01982

[22] Filed: Jan. 7, 1976

[21] Appl. No.: 646,992

[52] U.S. Cl. ..... 112/207

[51] Int. Cl.[2] ..... D05B 27/06

[58] Field of Search ..... 112/207, 212, 215, 203

[56] References Cited

UNITED STATES PATENTS

| | | | |
|---|---|---|---|
| 1,243,160 | 10/1917 | Grieb | 112/207 |
| 2,549,057 | 4/1951 | Chinnici | 112/207 |
| 3,530,809 | 9/1970 | Porter | 112/207 |

*Primary Examiner*—H. Hampton Hunter

*Attorney, Agent, or Firm*—Kenway & Jenney

[57] ABSTRACT

Disclosed is an improved top feed arrangement for cooperation with a conventional lower feed dog of a sewing machine, the lower feed dog cyclically engaging and disengaging the lower surface of material to be sewn in order to move that lower surface along a predetermined path through and past the sewing machine. The top feed arrangement comprises an upper feed dog carried by an arm that is pivotally linked to the drive means causing the cyclical movement of the lower feed dog. The arm is connected to those drive means at one end in a pivotal connection and the upper feed dog is carried at the other end of the arm. Biasing means bear against the arm at a location intermediate the upper feed dog and the pivotal connection to the drive means. A lifter means, responsive to the drive system that actuates the sewing machine needle, periodically moves the upper feed dog in a direction away from the lower feed dog against the force of the biasing means. Preferably, the arm which carries the upper feed dog is guided for movement in a vertical plane by a first bearing surface of the arm engaging a vertical confining surface of the sewing machine frame and a second bearing surface engaging a confining surface of the biasing means.

7 Claims, 3 Drawing Figures

WORK FEEDER FOR SEWING MACHINE

BACKGROUND OF THE INVENTION

The present invention relates to improvements in work feeders for sewing machines.

For many years, sewing machines have been provided with a feed mechanism, usually located in an opening in the work surface of the machine adjacent the stroke of the sewing machine needle and operating to engage the undersurface of the material being sewn and to advance the material to, and past, the needle. Because such a feeding arrangement only acts positively on the lowermost surface of the plural layers of material being sewn, it has long been desired to provide in a sewing machine an arrangement which would achieve a positive feed of the upper layer of material in addition to the conventional positive feed of the lower layer of material. While various approaches have been attempted (e.g., rotary feed wheels driven through flexible cables), success was minimal until the introduction of my "top feeder" that operated in synchronism with the conventional lower work feeder to provide for a positive feeding of the entire "sandwich" of material being sewn. This previous "top feeder" is the subject of the U.S. Porter Pat. No. 3,530,809, issued Sept. 29, 1970 and incorporated herein by reference.

While the feeding arrangement described and claimed in U.S. Pat. No. 3,530,809 has enjoyed substantial success, I have realized that various improvements over the feeding arrangement shown in that patent can yield substantially improved performance in various ways: e.g., less wear, smoother and quieter operation, simplicity of repair and interchange of parts, more positive gripping of the material being sewn, etc.

Accordingly, the primary object of the present invention is to provide a top feed arrangement for a sewing machine which has improved performance in one or more of the areas just mentioned.

SUMMARY OF THE INVENTION

Generally, the present invention provides an improved biasing arrangement for providing the force by means of which the top feed device engages the material to be sewn. According to the present invention, therefore, improvements are provided in a sewing machine having a stiching needle, a lower feed dog for engaging and disengaging the lower surface of the material to be sewn to move that lower surface along a predetermined path, an upper feed dog carried by an arm that is pivotally linked to the drive means that cause movement of the lower feed dog thereby providing synchronized movement of the lower and upper feed dogs, and control means for controlling the movement of the upper feed dog to alternately engage and disengage the upper surface of the material to be sewn. In such a sewing machine an improved control means is provided which comprises biasing means for biasing the upper feed dog toward the lower feed dog, the biasing means bearing against the aforementioned arm intermediate the upper feed dog and the location on the arm of its pivotal connection to the drive means, and lifter means responsive to the stitching needle's drive system for periodically moving the upper feed dog in a direction away from the lower feed dog against the force of the biasing means. According to the present invention, it has been found that this biasing arrangement provides for both a greater gripping force at the location of the upper feed dog and a reduced force on the pivotal connection between the arm and the drive means, so that there will be simultaneously an improved feeding of the material and a reduced wear at the pivotal link.

Preferably, in such a machine, a vertical surface of the top feeder arm engages an adjacent fixed vertical surface of the sewing machine frame so as to guide the arm to preserve alignment of the upper and lower feed dogs and to prevent "wobble" of the top feeder arm at high machine operating rates. Additionally, the biasing means may include a contact member for contacting the arm, the contact member including a surface for engaging the opposite side of the arm from that fixed vertical surface of the sewing machine, thereby further guiding the arm, and the attached upper feed dog, to motion in a vertical plane. In one embodiment, the lifter means comprise an arm driven by the sewing machine drive system for cyclical rotary movement, the arm supporting a needle bearing which engages a cam surface of the top feeder arm for lifting the arm upwardly away from the lower feed dog against the force of the biasing means.

BRIEF DESCRIPTION OF THE DRAWING

Other objects, features, and advantages of the invention will appear from the following description of a preferred embodiment thereof, taken together with the accompanying drawings, in which.

DETAILED DESCRIPTION OF A PARTICULAR PREFERRED EMBODIMENT

Figure 1:
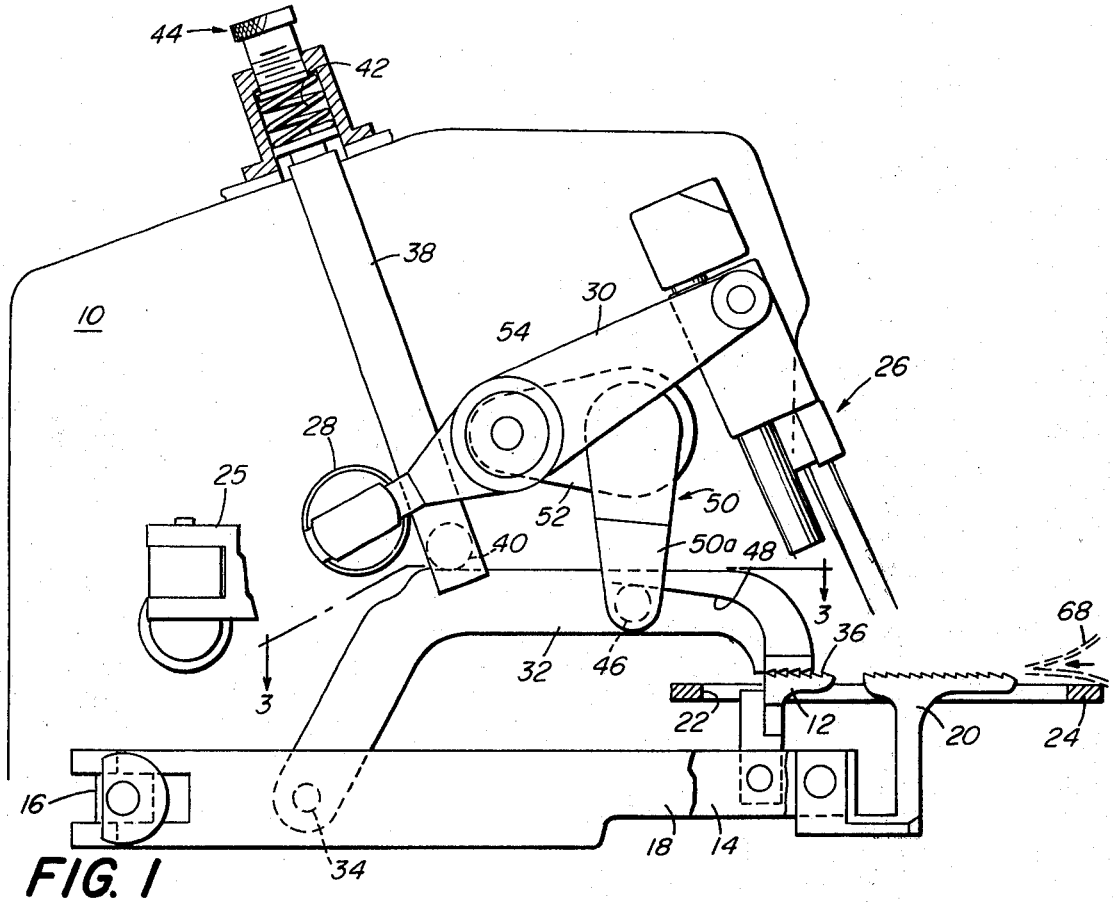
FIG. 1 is an end elevation of the feeding mechanism, also fragmentarily showing portions of the sewing machine to which the feeding device is applied, the upper feed dog being at one limit of its excursion.

Referring now to the drawing, there may be seen in outline a portion 10 of the main frame of the sewing machine. While the present invention may, of course, be applied to any of a wide variety of sewing machines where feed for the upper layer of an assembly to be sewn is needed, for purposes of illustration the drawing depicts a machine of the type disclosed in a catalog entitled "Parts Book, Revision No. 3 (Models Mo-804, Mo-814, Mo-816)", published by Tokyo Juki Industrial Co., Ltd, of Tokyo Japan. Reference is made to that catalog only for purposes of setting one background in which the present invention is operative.

Various conventional details have been eliminated from the drawing in order not to obscure the construction and operation of the improvements according to the present invention. Certain other conventional sewing machine elements are illustrated. For example, a main feed dog 12 is mounted on main feed bar 14 which extends rearwardly and terminates in a generally horizontal slot which receives a conventional feed bar slide block 16. A differential feed bar 18, substantially aligned with feed bar 14, supports a differential feed dog 20. Each of the feed dogs 12, 20 is disposed within an opening 22 in the cloth plate 24, the upper surface of which defines the plane of the path of materials to be sewn by the machine. While the details of the drives are omitted as not forming part of the present invention, being well known to those skilled in the art and illustrated more explicitly in the catalog cited above, the drive arrangements are such that the vertical motions of the feed dogs 12, 20 are the same, but their horizontal motions are somewhat different. (Also omitted is the conventional presser foot assembly which is secured to presser foot arm 25.)

The sewing machine needle assembly 26 is driven for reciprocal motion (compare FIGS. 1 and 2) by a drive shaft 28 through a link 30. As is conventional, material to be sewn (shown schematically at 68 in FIG. 1) enters the bite between the presser foot (not shown) and the upper surface of the cloth plate 24 in front of the needle assembly 26. In the conventional operation of a sewing machine, the feed dogs 12, 20 have their horizontal and vertical motions precisely timed relative to the reciprocal motion of the needle assembly 26 in order to advance the material to be sewn past the needle assembly 26. As described in the above-mentioned U.S. Pat. No. 3,530,809 with only the lower layer of material being positively advanced by the feed dogs 12, 20 a relative slippage between the layers of materials can, and often does, occur. This situation is corrected by the top feed assembly to be described.

An upper feed arm 32 is linked to the main feed arm 14 and is thus driven horizontally in synchronism with the main feed arm 14. In the embodiment illustrated, a pin 34 establishes the pivotal connection. The arm 32 projects forwardly from the location of the pin and terminates in a upper feed dog 36, which is aligned with the lower feed dog 12. A push rod 38 is disposed to have an integral stud 40 bearing against the upper edge of the feed arm 32 and is biased by means of a spring 42 to provide a downward force against the arm 32. The amount of force is adjustable with a conventional mechanism 44 which adjusts the force exerted by the spring 42. The force exerted through the rod 38 biases the arm in a clockwise direction, as viewed in FIGS. 1 and 2, with respect to the pivotal connection 34 to the arm 14 and thus urges the upper feed dog 36 toward the lower feed dog 12 to grip material therebetween.

The arm 32 is lifted against the force exerted by rod 38 is a timed relation with the reciprocating motion of the needle assembly 26, and with the horizontal motion of the various feed dogs, by means of a roller 46 which engages a downwardly facing cam surface 48 provided on the arm 32. The roller 46 is preferably in the form of a needle bearing secured to crank arm 50 connected to a link 52. Link 52 is driven by a motion converting unit 54 so as to be 180° out of phase with the motion of needle assembly 26.

Figure 3:
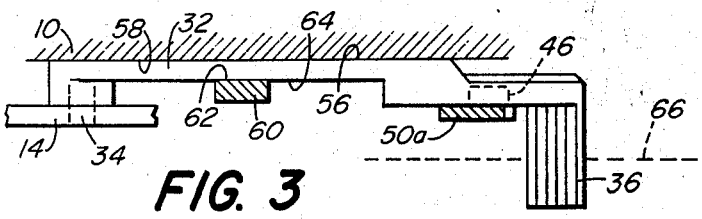
FIG. 3 is a view taken at 3—3 of FIG. 1

As best seen in FIG. 3, the arm 32 includes a generally planar vertically disposed guide surface 56 which abuts a vertically disposed guide surface 58 of the sewing machine frame 10. Because of this placement of the arm 32, the undercut cam surface 48 is provided on the opposite side of the arm 32 and the crank arm 50 includes a laterally offset lower portion **50*a* to properly position a needle bearing 46 beneath the surface 48. As also seen in FIG. 3, a projecting tab 60 of the push rod 38 includes a guide surface 62 which engages the generally planar vertical surface 64 of the arm 32 opposite the arm surface 56. This arrangement of the arm 32 adjacent the frame 10** not only reduces wobble, positions that arm in a plane in which it does not interfere with the material being sewn.

Figure 2:
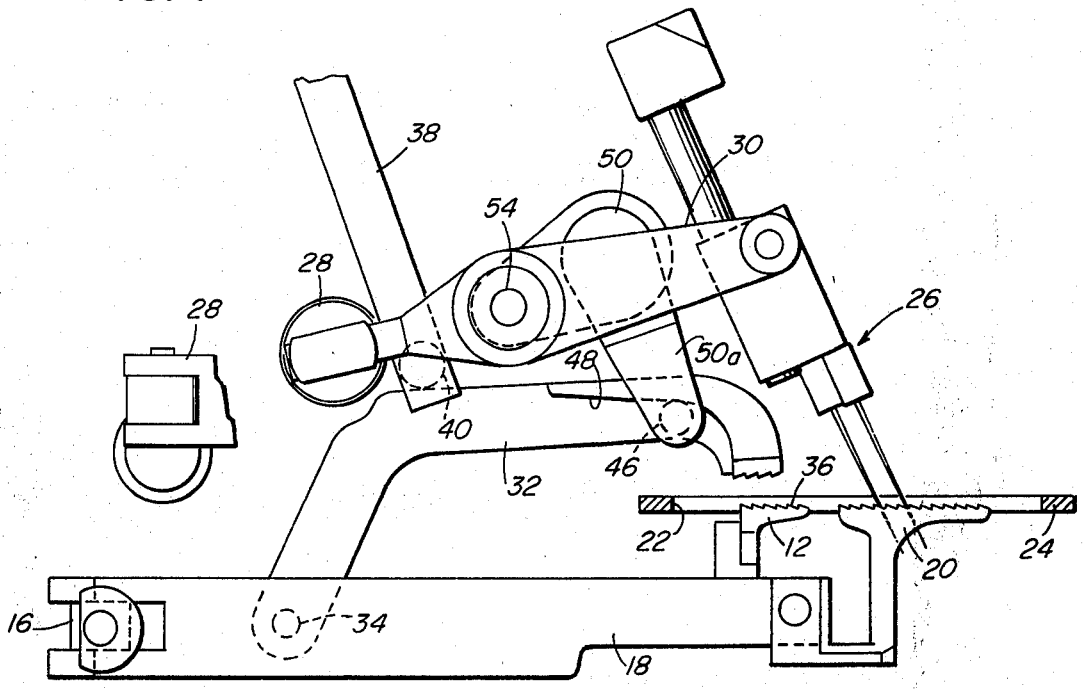
FIG. 2 is a view similar to that of FIG. 1 but showing the upper feed dog is at the upper limit of its excursion.

A comparison of FIGS. 1 and 2 will illustrate the operation of the feed apparatus. FIG. 1 shows the feed apparatus in the position which it assumes at the end of a feeding cycle, with both of the lower feed dogs 12, 20 in a raised position where their serrated upper surfaces extend above the level of the cloth plate 24 to engage the lower layer of material being fed into machine (indicated at 68). At this point in the cycle, the needle assembly 26 is raised and withdrawn from contact with the material being sewn.

Still referring to FIG. 1, the crank arm 50 is in an orientation such that the needle bearing 46 engages the rear, uppermost part of the cam surface 48, thereby permitting the arm 32 to decend to its most clockwise orientation under the force applied through the push rod 38. In that orientation, the feed dog 36 is at its closest approach to the feed dog 12 for maximum gripping of the complete "sandwich" of material being sewn. The subsequent rotation of the needle drive shaft 28 causes the needle assembly 26 to make a stitching stroke and causes the simultaneous reverse rotation of link 52. The crank arm 50, of course, moves with the link 52 and causes the bearing 46 to ride forward on the cam surface 48 thereby lifting the arm 32 such that the upper feed dog 36 is moved away from the lower feed dog 12, thereby freeing the material from the cooperative gripping action of the feed dogs 12, 36. At the same time, the lower feed dogs have been carried downwardly and to the right by their respective feed bars in a conventional fashion. The resulting configuration of the feeding apparatus and the needle assembly is illustrated in FIG. 2. As the operation of the machine continues, the needle assembly 26 is lifted once again, the dogs 12, 20 are slightly raised, and the upper feed arm 32 is lowered for the cooperative gripping of material by the feed dogs 12, 36. With the material thus gripped, the rearward (left as viewed in FIGS. 1 and 2) motion of feed arms 14, 18, 32 cause the advance of the material past the sewing location.

Various features of the top feed arrangement just described contribute to the improved operation which has been found to result. Thus, for example, the provision of the push rod 38 intermediate the feed dog 36 and the pivot pin 34 has been found to permit an increased downward biasing force at the location of the feed dog 36 (thereby providing a more positive gripping of the material) while resulting in a relatively small amount of force being exerted on the pin 34 (thereby reducing wear at a location of the apparatus susceptible to failure). The noise of operation and wobble of the upper feed arm 32 are reduced by the upper feed arm control arrangement which includes the confining surfaces 58 and 62. The positioning of the top feed arm 34 intermediate the plane of guide surface 58 and the plane (indicated at 66) in which the needle assembly 26 moves assures the non-interference of the arm 32 with the material as it proceeds in its normal path to, through, and past the sewing location.

The described construction also facilitates the simple adjustment of the extent of vertical motion of the top feed dog 36. This is accomplished by simply altering the rotational orientation of the crank arm 50 with respect to the link 52. One means for accomplishing this is to provide a spline (not shown) on the face of crank arm 50 which engages the link 52 and a series of mating, angularly spaced slots in the opposed face of link 52. A change in the slot which the spline engages, will, of course, change the angular orientation of the crank arm 50 with respect to the link 52, and thus will change the amount of vertical motion of arm 32 caused by the incremental rotation of the crank arm 50.

While a particular preferred embodiment of the present invention has been illustrated in the accompanying drawing and described in detail herein, other embodiments are within the scope of the invention and the following claims.

I claim:

1. In a sewing machine having a stitching needle, a lower feed dog for engaging and disengaging the lower surface of material to be sewn to move said lower surface along a predetermined path, a drive system for imparting reciprocating motion to said stitchng needle, drive means for reciprocating said lower feed dog with a motion including a component parallel to said predetermined path, an upper feed dog carried by an arm pivotally linked to said drive means for causing movement of said upper feed dog in synchronism with said lower feed dog, and control means for controlling the movement of said upper feed dog to alternately engage and disengage the upper surface of said material to be sewn to move said upper surface along said predetermined path, the improvement wherein said control means comprise biasing means for biasing said upper feed dog toward said lower feed dog, said biasing means bearing against said arm intermediate said upper feed dog and the location on said arm of said pivotal connection to said drive means, and lifter means responsive to said drive system for periodically moving said upper feed dog in a direction away from said lower feed dog against the force of said biasing means.

2. In a sewing machine as defined in claim 1, the improvement wherein said control means further comprise a vertical surface on said arm which engages an adjacent fixed vertical surface of the sewing machine, said surfaces cooperating to guide said arm so that said upper and lower feed dogs remain aligned with each other during the movement of said upper feed dog away from and toward said lower feed dog.

3. In a sewing machine as defined in claim 2 the improvement wherein said biasing means include a contact member for contacting said arm, said contact member including a surface for engaging the opposite side of said arm from said vertical surface, thereby further guiding the motion of said arm and said upper feed dog.

4. In a sewing machine as defined in claim 1 the improvement wherein said arm includes a substantially downwardly facing cam surface and said lifter means comprise an arm driven by said drive system and supporting a rotatable member that engages said cam surface.

5. In a sewing machine as defined in claim 4, the improvement wherein said rotatable member comprises a needle bearing.

6. In a sewing machine having a generally planar surface across which material to be sewn moves, a stitching needle supported for reciprocating motion toward and away from said generally planar surface at a predetermined location thereon, a drive system for imparting reciprocating motion to said stitching needle, a lower feed dog for engaging and disengaging the lower surface of material to be sewn to move said lower surface along a predetermined path across said generally planar surface, drive means for driving said lower feed dog, a housing at least partially enclosing and supporting said drive system and defining a substantially vertical surface parallel to said predetermined path and spaced apart from said stitching needle, an upper feed dog carried by an arm pivotally linked to said drive means, and control means for controlling the movement of said upper feed dog, the improvement wherein said upper feed dog is connected to said arm at the edge of said upper feed dog closest said housing vertical surface and wherein all portions of said arm above said generally planar horizontal lie intermediate said housing vertical surface and the plane of reciprocating motion of said stitching needle, whereby the sewn material can preceed along said predetermined path without inhibiting contact therewith by said arm.

7. In a sewing machine as defined in claim 6, the improvement wherein said control means comprise a surface of said arm in contact with said housing vertical surface, those surfaces cooperating to guide said arm so that said upper and lower feed dogs remain vertical aligned during the operation of the sewing machine.

* * * * *